US006380834B1

(12) United States Patent
Canzano et al.

(10) Patent No.: US 6,380,834 B1
(45) Date of Patent: Apr. 30, 2002

(54) PLANAR MAGNETIC ASSEMBLY

(75) Inventors: Steven M. Canzano, Bellevue, WA (US); Howard Webber, Cupertino; Michael McVey, Manhattan Beach, both of CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/516,727

(22) Filed: Mar. 1, 2000

(51) Int. Cl.[7] ..... H01F 5/00
(52) U.S. Cl. ..... 336/200; 336/83; 336/208
(58) Field of Search ..... 336/200, 234, 336/83, 223; 335/18; 361/42–51; 29/602.1

(56) References Cited

U.S. PATENT DOCUMENTS 5,010,314 A * 4/1991 Estrov ..... 336/198
5,598,135 A * 1/1997 Maeda et al. ..... 336/200
5,631,822 A * 5/1997 Silberkleit et al. ..... 336/200
5,844,461 A * 12/1998 Faulk et al. ..... 336/206
5,900,797 A * 5/1999 Dougauchi ..... 336/200
6,023,214 A * 2/2000 Ohta et al. ..... 336/84 R

* cited by examiner

*Primary Examiner*—Lincoln Donovan
*Assistant Examiner*—Tuyen Nguyen
(74) *Attorney, Agent, or Firm*—Perman & Green, LLP

(57) ABSTRACT

A magnetic assembly is constructed comprising a first core portion, a second core portion, and a winding assembly. The first and second core portions each include a base portion and a plurality of projections extending from the base portion. The winding includes a plurality of stacked layers having conductive paths applied to their surfaces. The winding is constructed with a bore, wherein each conductive path encircles the bore. A number of the stacked conductive layers form a primary winding, and a number of the stacked conductive layers form a secondary winding. The winding is disposed over the first core portion in a manner so that a projection engages the opening of the winding to provide magnetic coupling of winding and core. The second core portion is disposed over the first core portion to form a closed magnetic circuit through and around the winding.

2 Claims, 5 Drawing Sheets

PLANAR MAGNETIC ASSEMBLY

BACKGROUND OF THE INVENTION

Conventional magnetic devices such as, inductors and transformers, are typically constructed by winding turns of wire around a ferromagnetic core. An inductor 1 is shown in FIG. 1 and includes a magnetic core 2. A number of turns of wire are wrapped around the core 2 to form a winding 3. The inductance provided by inductor 1 is proportional to the number of turns included in the winding 3.

A transformer 4 is shown in FIG. 2 and includes primary winding 5 and secondary winding 6 wrapped around a core 7. The transformer 4 is employed to convert a voltage $V_p$ to a voltage $V_s$. Voltage $V_s$, is equal to the voltage $V_p$ multiplied by the ratio of the number of turns of wire around the core 7 ($N_s$) in the secondary winding 6 to the number of turns ($N_s$) in the primary winding 5. This relationship is expressed by the formula:

$$V_s=((N_s)/(N_p)*V_p)$$

Conventional inductors and transformers, such as those shown in FIGS. 1 and 2, often suffer from a number of drawbacks. More particularly, the position of the winding turns with respect to the core in these devices influences various performance characteristics of the devices, such as leakage, and winding-to-winding capacitance. In cases where more than one transformer or inductor is being fabricated, imprecise device fabrication methods can cause variations in performance from device to device.

A significant amount of manual labor is required to fabricate these magnetic devices, especially in the winding of the wire around the cores in a controlled fashion. Therefore, it can be difficult to fabricate large quantities of these devices inexpensively while maintaining close manufacturing tolerances. In addition, significant design attention must be given to minimizing parasitic leakage inductance levels which waste power and reduce performance efficiency.

Conventional magnetic devices tend to be undesirably large in size owing to the large number of winding turns employed and the magnetic core construction. Many of these devices therefore, are unsuitable for use in applications where space is a concern as it is in the design of electrical power systems for satellites. For such applications, it is desirable to provide high performance transformers that are of compact size and weight.

It is an object of this invention to provide a unique structure for a high performance transformer which lends itself to a simplified manufacturing process. In addition it is an object of this invention to provide a method of manufacture which can maintain close tolerances in a reliable fashion. It is a further object of this invention to provide such performance benefits while reducing the overall weight and size of the device to enable its beneficial use in satellite systems.

SUMMARY OF THE INVENTION

A transformer is constructed having a core and windings assembled in a generally flat planar shape. The core is divided into first and second portions. The first and second core portions are constructed of a ferromagnetic material, such as ferrite, and each is comprised of a base and a plurality of integral projections extending generally perpendicular to the base. The core portions are further constructed to mate to form a continuous magnetic circuit. In the preferred embodiment each of the core portions are formed having an "E" shaped cross section.

The winding assembly is constructed of stacked layers, each of the layers having conductive paths printed thereon. Each of the layers also has a centrally located opening which are aligned in the stacked position and the printed paths generally surround the opening.

The conductive paths of selected stacked layers are electrically interconnected to form a primary winding, and the conductive paths of the other stacked layers are electrically interconnected to form secondary windings. The winding assembly further includes insulating spacers disposed between adjacent winding layers to separate the adjacent conductive paths and prevent shorting and reduce leakage between individual winding paths.

The winding assembly is assembled over one of the core portions with the central projection of the core portion extending through the central opening of the stacked winding assembly. The assembly of the device is completed by mating the other core portion with the first portion to create a continuous magnetic circuit around and through the stacked windings.

In this manner a transformer or other magnetic device can be constructed to accommodate a wide variety of performance specifications. The manufacture of each of the elements can be controlled to close tolerances and can be adjusted to accommodate high power applications typically encountered in satellite systems while avoiding

BRIEF DESCRIPTION OF THE DRAWINGS

The above and other features of the invention are made more apparent in the following description when read in conjunction with the attached Drawings, wherein.

DETAILED DESCRIPTION OF THE INVENTION

Figure 1:
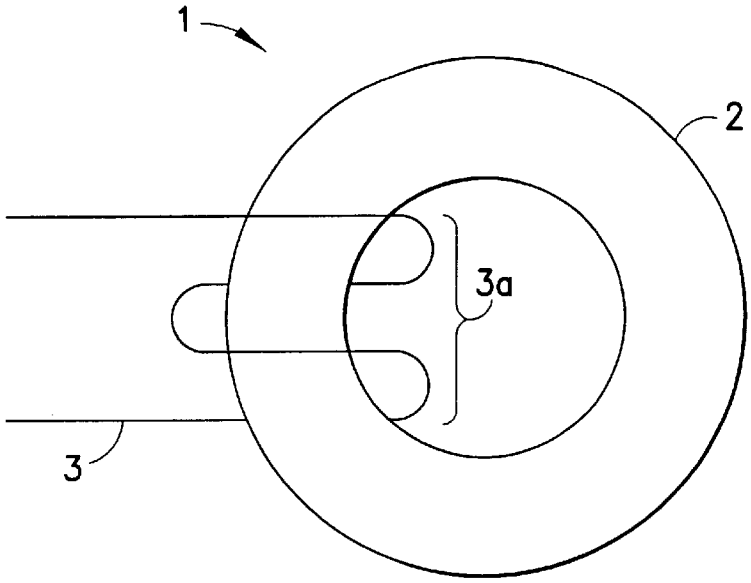
FIG. 1 PRIOR ART
FIG. 1 shows an inductor that is constructed in accordance with the prior art.
Figure 2:
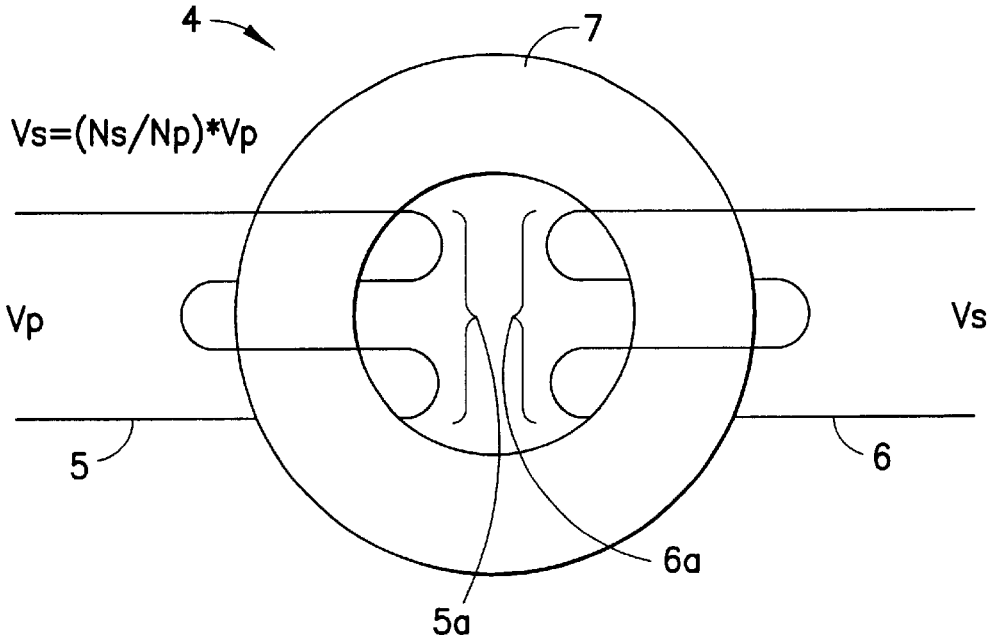
FIG. 2 PRIOR ART
FIG. 2 shows a transformer that is constructed in accordance with the prior art.
Figure 3:
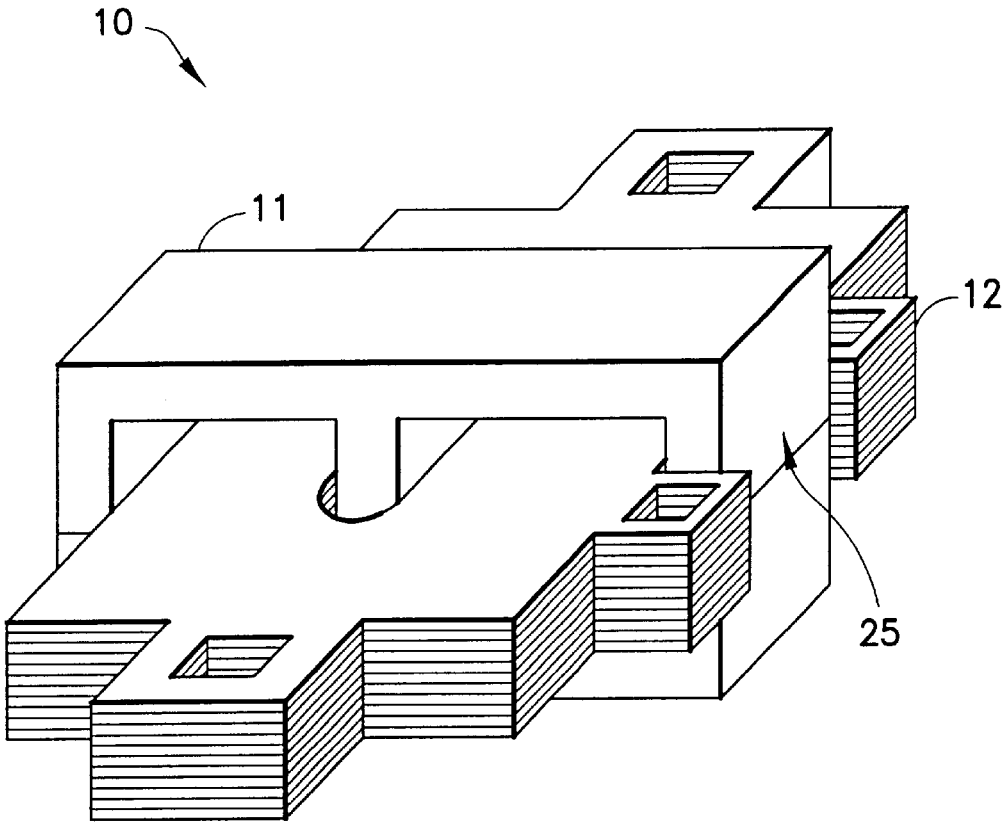
FIG. 3 shows a magnetic device constructed in accordance with this invention.

The magnetic assembly 10, as show in FIG 3, is constructed having a ferromagnetic core 11 and windings 12 which are formed in a generally flat planar configuration. The core 11 comprises a closed magnetic circuit having paths which extend through and around the windings 12. The windings 12 are constructed of a stack of individual layers 25 upon which are printed a conductive path to allow the flow of current in the windings.

Figure 4:
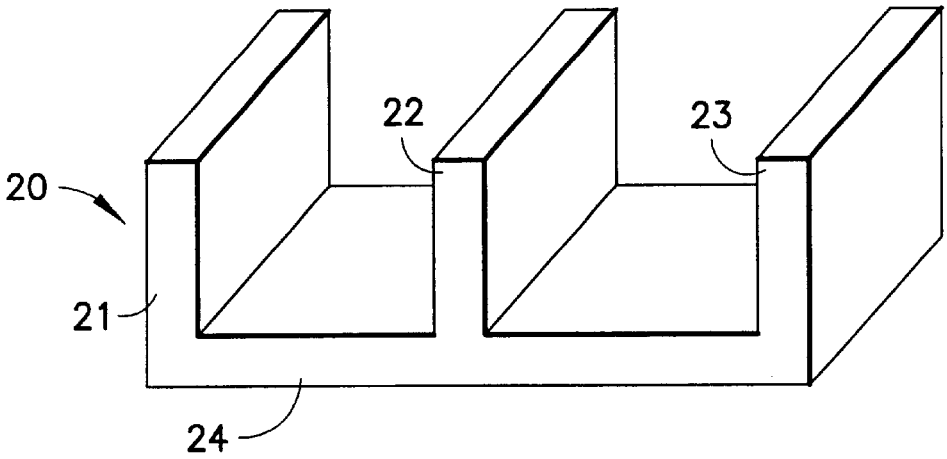
FIG. 4 is a perspective view of a core portion of the invention.
Figure 6:
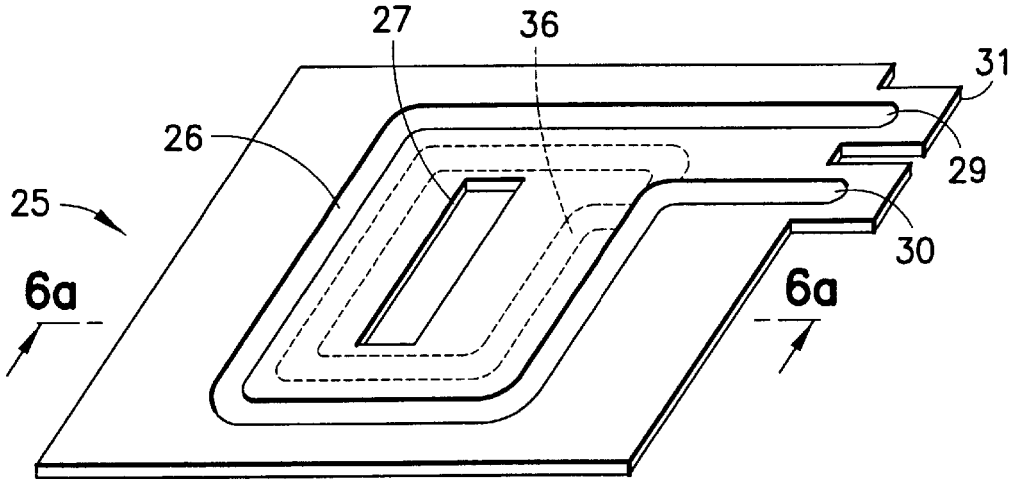
FIG. 6 is a perspective view of a winding layer according to this invention.
Figure 6A:
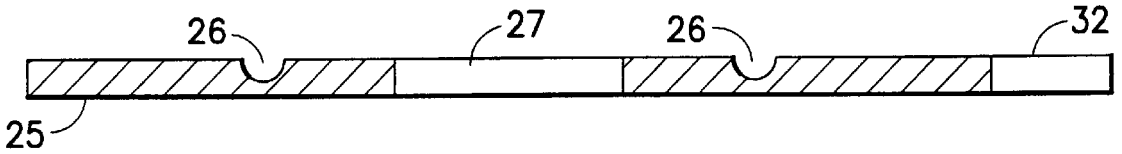
FIG. 6*a* is a sectional view of the winding layer of FIG. 6 through section lines a—a.

The core 11 is constructed of material having suitable magnetic properties to support the function of the device and has a pair of mating portions 20, as shown in FIG. 4. In a preferred embodiment of the invention, the core portion 20 has a substantially E shaped cross section and consists of legs 21, 22, and 23 extending outward from a base 24. As shown in FIG. 6, core portions 20 and 20*a* are arranged in opposing positions and are joined to form a closed magnetic circuit through the cooperative engagement of legs 21, 22, and 23 of core portion 20 with legs 21*a*, 22*a*, and 23*a* of core portion 20*a*. In some embodiments, the center legs 22 and 22*a* may be devised with a gap to provide additional inductance. The two core portions may be secured together by an epoxy adhesive or other means.

Figure 5:
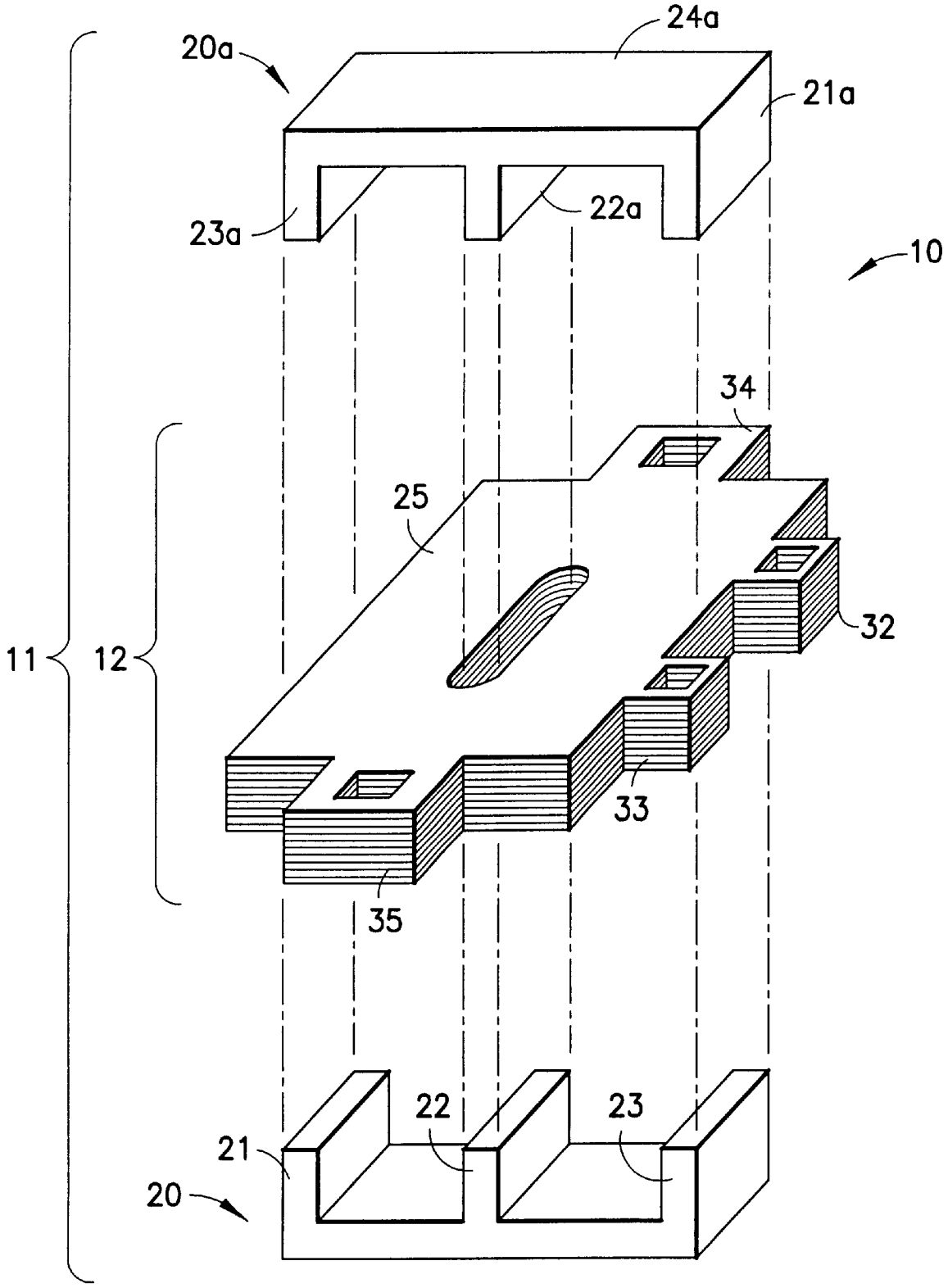
FIG. 5 is an exploded view of the magnetic assembly of this invention.

The winding 12 is shown in FIG. 5 as part of the exploded assembly 10. It is constructed from a stack of winding layers 25, see FIG. 6, on which is applied a conducting path 26. The conducting paths 26 end in terminals 29 and 30 which extend onto tabs 32, 33, 34, and 35 for access after assembly. Each of the winding layers 25 are configured with an opening 27 which align to form a bore 28 in the stacked condition. The conductive material of the path 26 is configured to circumscribe the opening 27 to generate a magnetic flux in the core 11 when a current flows in the conductive path 26. The conductive path 26 may be coiled, as shown in phantom in FIG. 6, to form a second winding 36 on the layer 25. Winding layer 25 may be formed using well known printed circuit board techniques or other means depending on the requirement of the application. The thickness of the path 26 is controlled to provide a range of current carrying capacity. The conductive path utilized in the magnetic device of this invention will in general be thicker than the normal printed circuit board, to accommodate higher power requirements.

The winding layers 25 are insulated from adjacent layers by the circuit board material, which typically may be a polyimide film. The conductive path 26 is bonded to the board 31 under pressure and steps should be taken to avoid the formation of voids which may cause dielectric breakdown. It is also advantageous to apply the conductive path in a pattern that avoids sharp angles to reduce field stress. This will allow the operation of the device 10 at higher voltage.

In high power applications it may be necessary to construct the conducting path by depositing a conductive material, such as copper, silver, or aluminum onto an insulating plate. The plate may be grooved to define the path and allow for a thicker application of conductive material to the insulating path to provide higher current carrying capacity.

In either embodiment, the application of the conductive path can be critically controlled resulting in improved repeatability from part to part. The reduction in size of the windings is only limited by the thickness of the polyimide board and the insulating layer.

It is essential to prevent conduction of current between the winding layers 25 and this may require additional layers of insulating material alternating with the winding layers 25. The entire winding assembly 12 may be encapsulated in an epoxy compound to minimize leakage along the edges of the layers 25.

In an alternative embodiment the winding layer 25 may be constructed by cutting a conductive foil in the shape of the desire conducting path 26. The conductive foil path 26 is sandwiched between layers of insulating mesh to form a winding layer. The stacked assembly may be vacuum impregnated with an insulating material to provide the required electrical separation of the individual winding layers.

Figure 7A:
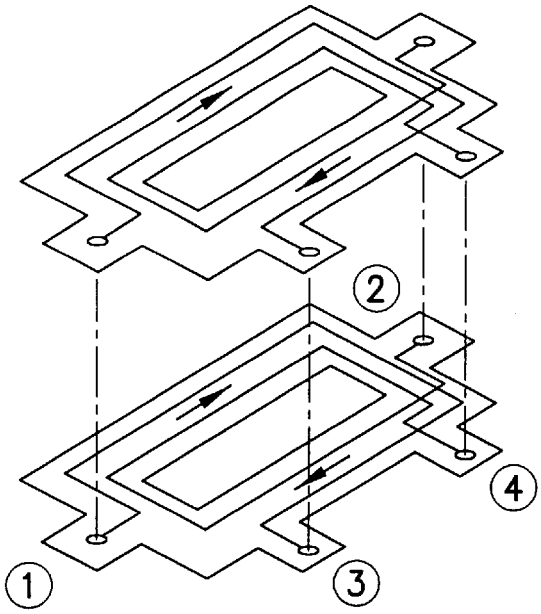
FIGS. 7*a* and 7*b* are diagrams of interconnected winding layers fashioned as an inductor and the corresponding electrical circuit.
Figure 7B:
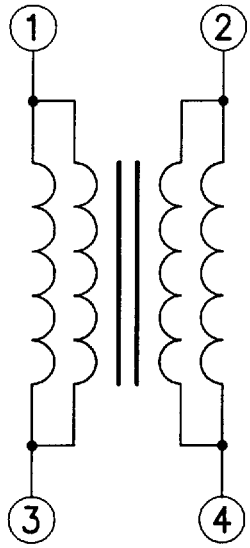
Figure 8A:
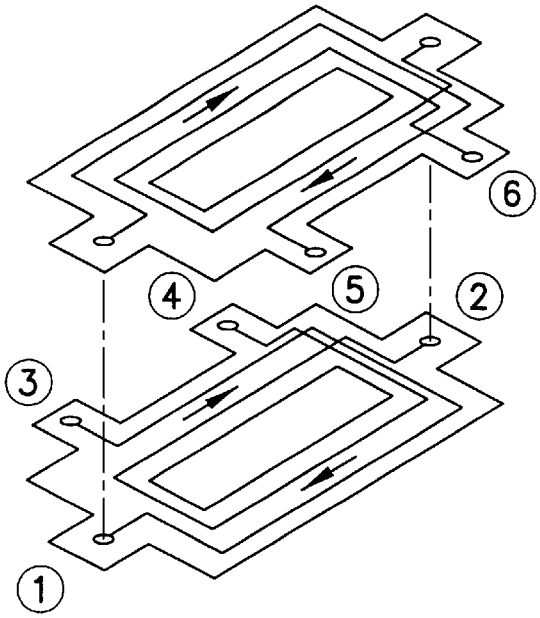
FIGS. 8*a* and 8*b* are schematic diagrams of interconnected winding layers and the corresponding electrical circuit.
Figure 8B:
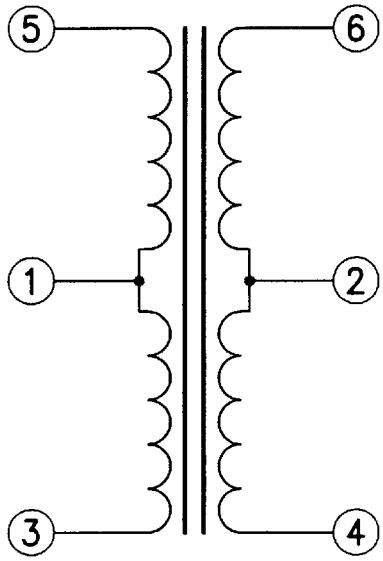

As shown in FIGS. 7*a*, 7*b* and 8*a* an 8*b*, the individual conductive paths 26 of the winding layers 25 are electrically interconnected to provide primary and secondary windings. This can be accomplished in a wide variety of ways only two of which are shown for the purpose of illustration. FIGS. 7*a* and 7*b* show the windings layers 25 with the conductive paths 26 connected to form an inductor having primary and secondary windings connected in parallel and FIGS. 8*a* and 8*b* show the conductive paths 26 connected in series to form a center tapped transformer. Multiple conductive paths, electrically insulated from each other may be constructed within a single winding layer, thereby increasing the possible combinations. In printed circuit applications, the layers may be connected by means of pins which extend through plated through holes. In encapsulated applications, tabs are constructed which may be wired in the appropriate configuration. As shown in FIG. 5, tabs 32–35 are provided and each provides electrical access to a particular winding layer to allow interconnection according to the application.

To assemble the magnetic device 10, the winding layers 25 are stacked to provide the number of windings required by the application and appropriate insulation is applied to electrically isolate the winding 12. The winding stack 12 is nested on one of the core portions 20 with the center leg 22 protruding into the bore 28. The opposing core portion 20*a* is mated with its counterpart and glued or secured together to form a closed magnetic circuit. The assembly is now complete with the coils formed by the conductive paths 26 magnetically coupled to and electrically insulated from the core 11. To accommodate the core the tabs 32–35 are arranged to provide room for the core legs 21 and 23. The physical relation of the core and coil in the assembly of this invention is designed to minimize space. Although the rectangular shape of the illustrated embodiment may be advantageous in certain applications, the core 11 and windings 12 can have most any shape and relation consistent with the magnetic coupling of the two elements. This enables flexible design choices to fit the envelope of the application.

While the invention has been particularly shown and described with respect to preferred embodiments thereof, it will be understood by those skilled in the art that changes in form and details may be made therein without departing from the scope and spirit of the invention as described in the claims.

What is claimed is:

1. An electro-magnetic assembly comprising:

a core constructed of magnetizable material and having first and second portions, said first portion having a base and at least one projection extending transverse to said base, said second portion being formed to mate with said first portion to form a closed magnetic circuit;

a winding constructed having a stack of at least one layer, each of said at least one layer further comprising:

a planar element constructed of electrical insulating material having an opening constructed therein, said planar element having a groove constructed therein forming a loop surrounding said opening, said groove being filled with a conductive material to form a conductive path; and wherein said winding is assembled on said first core portion with said projection extending into said opening of said winding to establish magnetic coupling between the winding and core, said second core portion being engaged with said first core portion to provide a closed magnetic circuit through said opening and around said winding.

2. An electro-magnetic assembly comprising:

a core constructed of magnetizable material and having first and second portions, said first portion having a base and at least one projection extending transverse to said base, said second portion being formed to mate with said first portion to form a closed magnetic circuit, a winding constructed having a stack of at least one layer, each of said at least one layer further comprising:

a planar element constructed of electrical insulating material having an opening constructed therein, said planar element further comprising:

a first layer constructed of mesh material impregnated with a insulating material;

a conductive path formed from a conductive foil material and cut to form a loop;

a second layer constructed of mesh material impregnated with and insulating material; and wherein the said planar element is assembled by layering said conductive path between said first and second insulating layers with said conductive path loop surrounding said opening of said planar element;

wherein said winding is assembled on said first core portion with said projection extending into said opening of said winding to establish magnetic coupling between the winding and core, said second core portion being engaged with said first core portion to provide a closed magnetic circuit through said opening and around said winding.

* * * * *